US011643298B2

(12) United States Patent
Johnson

(10) Patent No.: US 11,643,298 B2
(45) Date of Patent: May 9, 2023

(54) BIDIRECTIONAL SPOOL APPARATUS AND METHOD OF USE

(71) Applicant: Corey B. Johnson, Hyrum, UT (US)

(72) Inventor: Corey B. Johnson, Hyrum, UT (US)

( * ) Notice: Subject to any disclaimer, the term of this patent is extended or adjusted under 35 U.S.C. 154(b) by 198 days.

(21) Appl. No.: 17/242,420

(22) Filed: Apr. 28, 2021

(65) Prior Publication Data

US 2021/0245991 A1 Aug. 12, 2021

(51) Int. Cl.
*B65H 75/40* (2006.01)
*B65H 75/44* (2006.01)
*A43C 11/16* (2006.01)

(52) U.S. Cl.
CPC ..... *B65H 75/4492* (2013.01); *A43C 11/165* (2013.01); *B65H 75/40* (2013.01)

(58) Field of Classification Search
CPC .... B65H 75/40; B65H 75/4492; A43C 11/165
See application file for complete search history.

(56) References Cited

U.S. PATENT DOCUMENTS 3,876,045 A * 4/1975 Knarreborg ..... H02G 11/02 242/395
4,506,446 A * 3/1985 Mitchell ..... G01B 3/1041 33/767
8,365,887 B2 * 2/2013 Fischer ..... B65H 75/4431 242/378.1
8,434,200 B2 5/2013 Chen ..... 24/68
8,468,657 B2 6/2013 Soderberg ..... 24/68
8,684,295 B2 * 4/2014 Taketsuna ..... H02G 11/02 242/385.4
9,138,030 B2 9/2015 Soderberg ..... 24/68
9,259,056 B2 2/2016 Soderberg ..... A43C 11/165
10,123,589 B2 11/2018 Soderberg ..... A43C 11/00
10,863,796 B2 12/2020 Soderberg ..... A43C 11/00
2010/0139057 A1 6/2010 Soderberg ..... 24/68
2013/0014359 A1 1/2013 Chen ..... 24/68
2013/0277485 A1 10/2013 Soderberg ..... A43C 11/165
2015/0101160 A1 4/2015 Soderberg ..... A43C 11/165
2016/0198803 A1 7/2016 Soderberg ..... A43C 11/00
2019/0069641 A1 3/2019 Soderberg ..... A43C 11/00
2020/0179172 A1 6/2020 Johnson ..... A61F 9/029
2020/0390196 A1 12/2020 Manzato ..... A43C 11/165

* cited by examiner

*Primary Examiner* — Sang K Kim
(74) *Attorney, Agent, or Firm* — Michael R Schramm

(57) ABSTRACT

Disclosed is a bidirectional spool apparatus (BSA) and method of use. The BSA comprises a spool apparatus having a plurality of spools, a plurality of cables, and an adjustment knob. When the BSA is in a first mode, rotation of the adjustment knob causes a corresponding rotation of a first spool in a tightening direction and a tightening of a first cable but allows a second cable to rotate substantially freely, and such that when the BSA is in a second mode, rotation of the adjustment knob causes a corresponding rotation of a second spool in a tightening direction and a tightening of a second cable but allows a first cable to rotate substantially freely. Switching of the BSA from a first mode to a second mode and vice versa is accomplished by pulling the adjustment knob out a distance and by pushing the adjustment knob in a distance.

20 Claims, 8 Drawing Sheets

BIDIRECTIONAL SPOOL APPARATUS AND METHOD OF USE

FIELD OF THE INVENTION

The present invention relates to spool apparatuses, and in particular, to spool apparatuses for use in tightening and loosening cables and like elongated drawing or securing members.

BACKGROUND OF THE INVENTION

Various means are known in the art for securing tightening cables and like elongated drawing or securing members. However, such means are not heretofore known to have convenient bidirectional operation or to have a positive loosening ability. Examples of spool apparatuses are disclosed in the following list of US patents and applications, all of which are expressly incorporated herein by reference: U.S. Pat. No. 8,434,200 to Chen, U.S. Pat. No. 8,468,657 to Soderberg, U.S. Pat. No. 9,138,030 to Soderberg, U.S. Pat. No. 9,259,056 to Soderberg, U.S. Pat. No. 10,123,589 to Soderberg, U.S. Pat. No. 10,863,796 to Soderberg, 20100139057 to Soderberg, 20130014359 to Chen, 20130277485 to Soderberg, 20150101160 to Soderberg, 20160198803 to Soderberg, 20190069641 to Soderberg, 20200179172 to Johnson, and 20200390196 to Manzato.

SUMMARY OF THE INVENTION

The present invention is a bidirectional spool apparatus (BSA) and method of use. The BSA comprises a spool apparatus having a plurality of spools, a plurality of cables (or like elongated drawing or securing members), with each cable threaded or wound around a respective spool, and an adjustment knob. The BSA is adapted such that when in a first mode, rotation of the adjustment knob causes a corresponding rotation of a first spool in a tightening direction and a tightening (reduced payout) of a first cable but allows a second cable to rotate substantially freely (but for friction of the apparatus), and such that when in a second mode, rotation of the adjustment knob causes a corresponding rotation of a second spool in a tightening direction and a tightening (reduced payout) of a second cable but allows a first cable to rotate substantially freely (but for friction of the apparatus). The BSA is further adapted such that switching of the BSA from a first mode to a second mode and vice versa is accomplished by pulling the adjustment knob out a distance along the rotational axis of the adjustment knob and by pushing the adjustment knob in a distance along the rotational axis of the adjustment knob.

DESCRIPTION OF DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
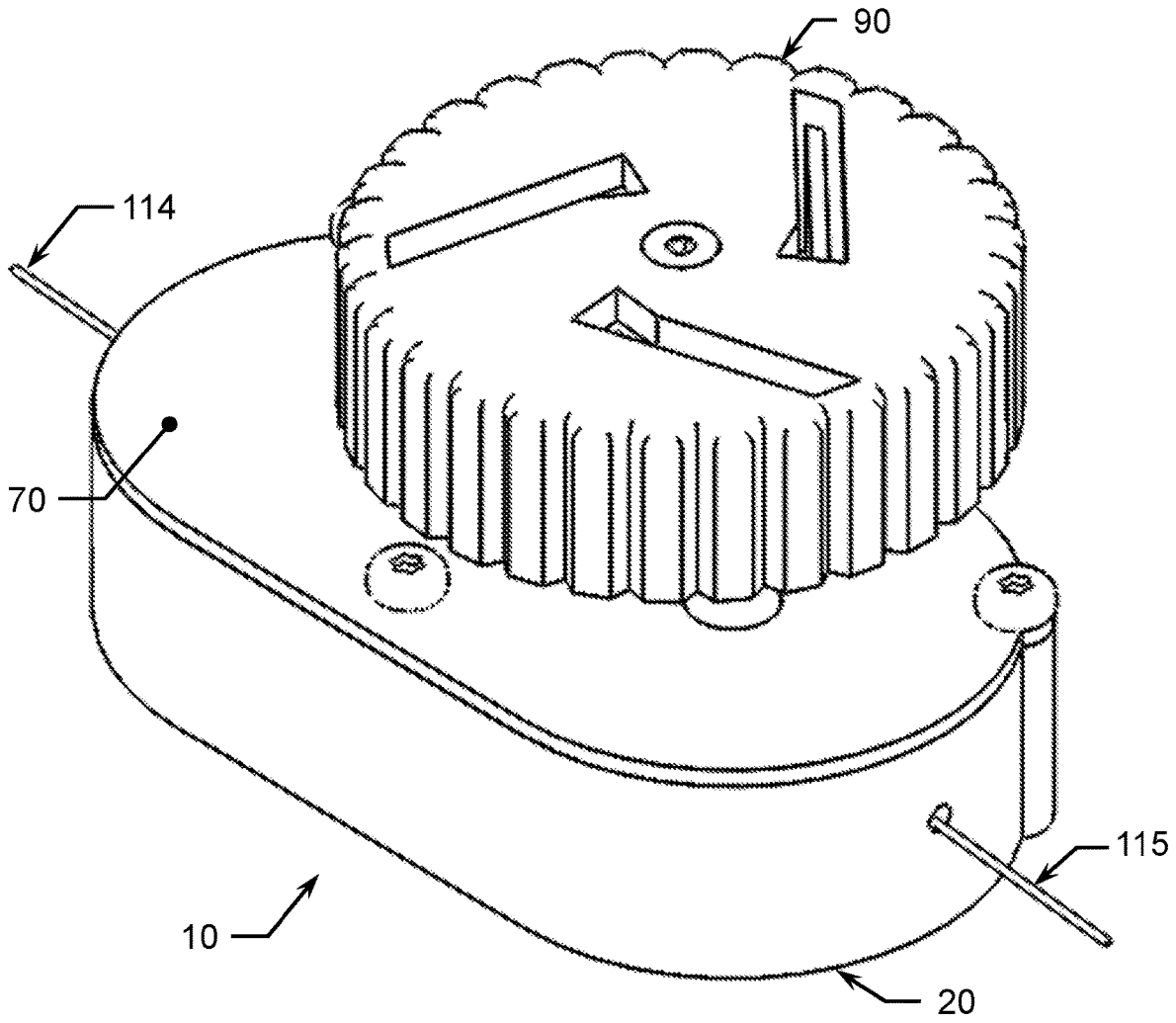
FIG. 1 is an assembled trimetric view of the BSA.
Figure 2:
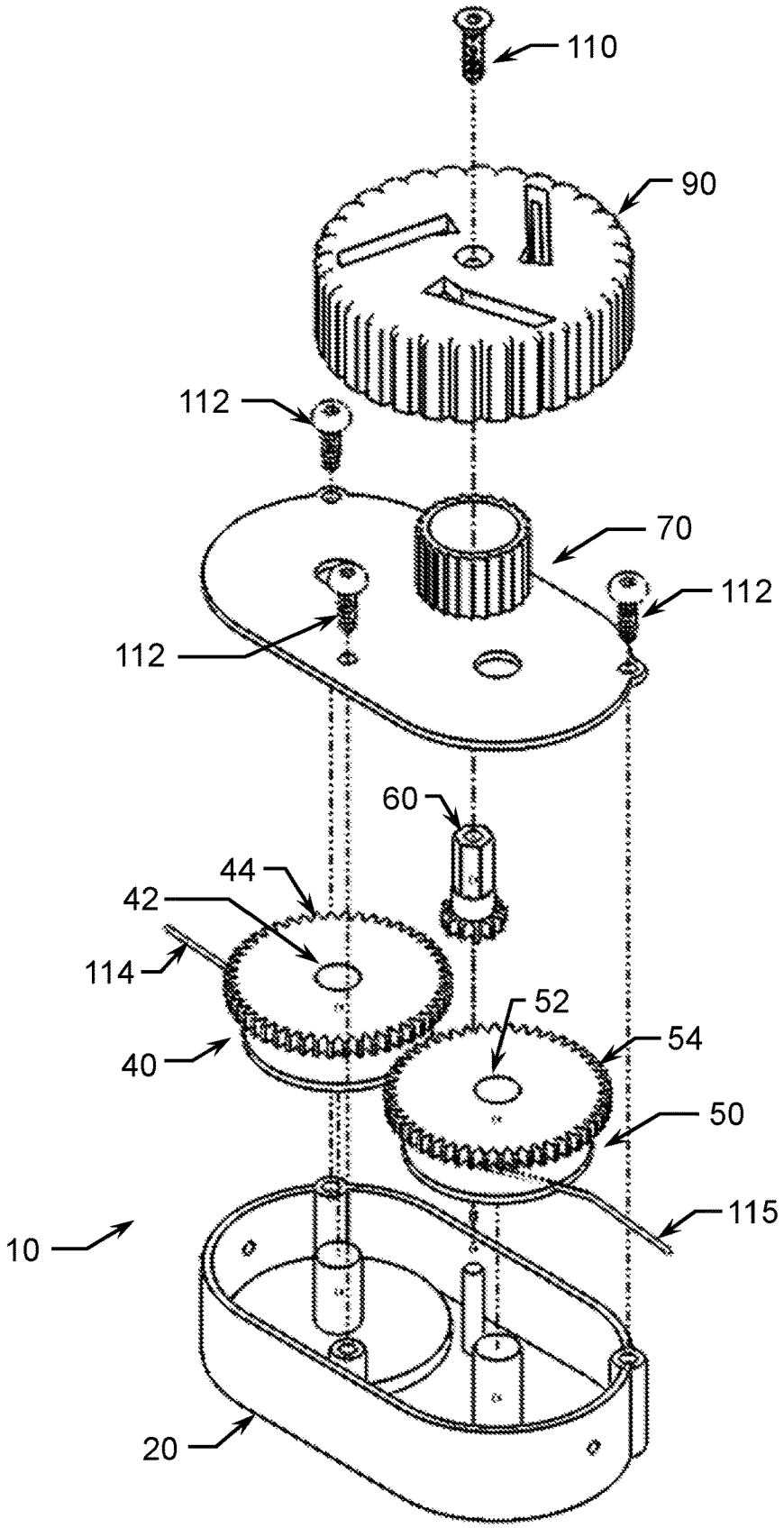
FIG. 2 is an exploded trimetric view of the BSA of FIG. 1.
Figure 3:
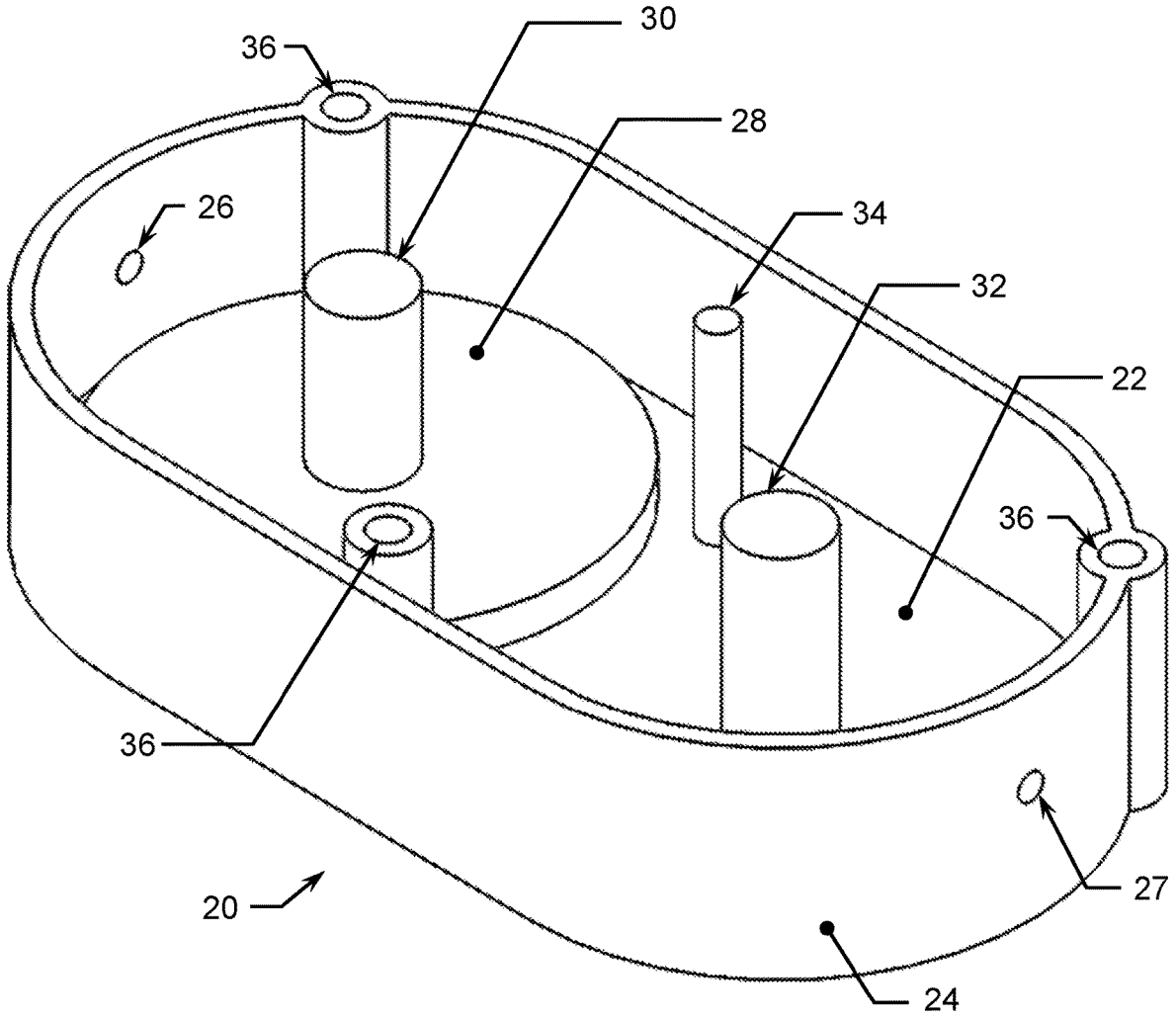
FIG. 3 is a trimetric view of the housing of the BSA.
Figure 4:
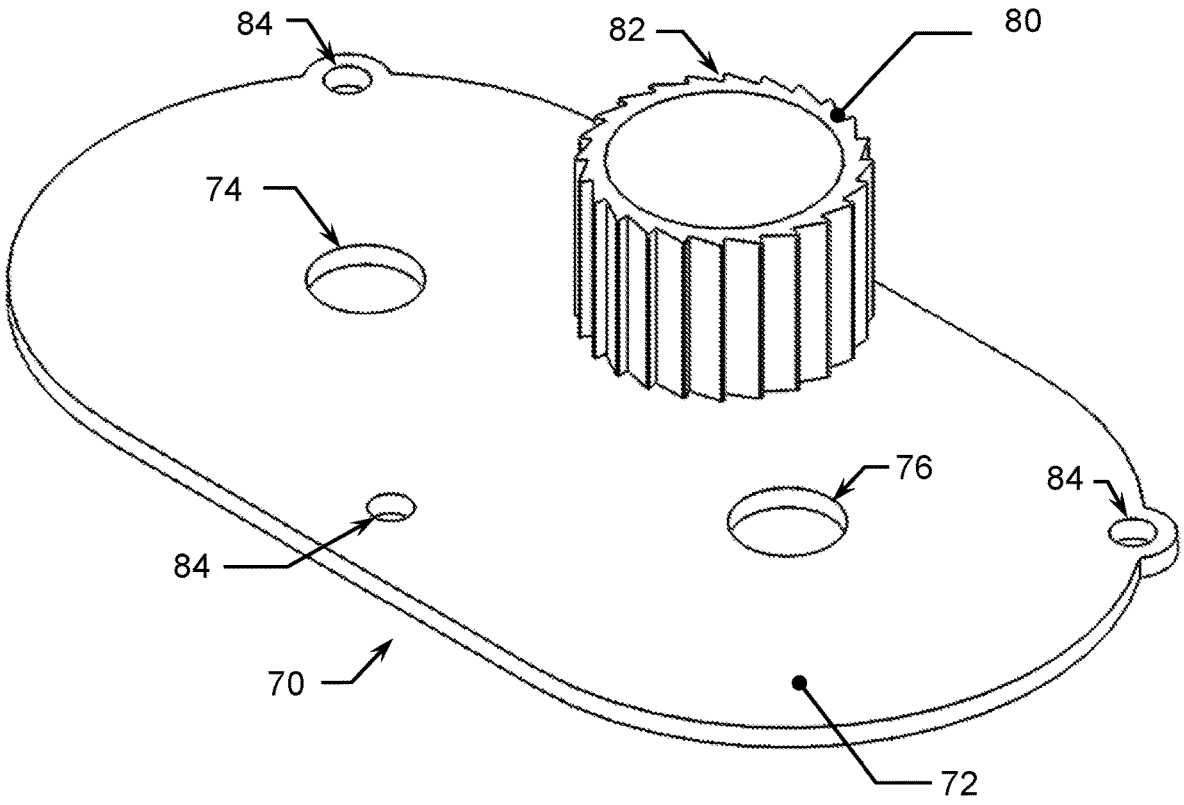
FIG. 4 is a trimetric view of the cover of the BSA.
Figure 5:
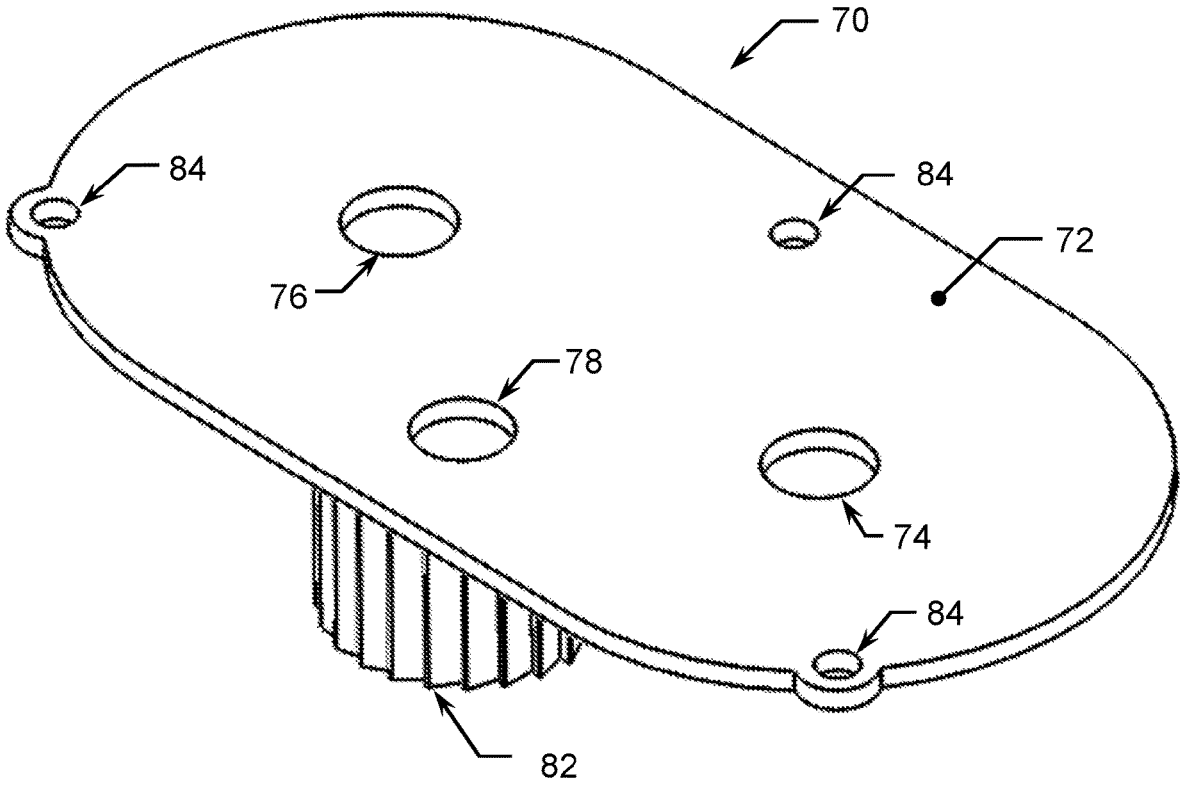
FIG. 5 is an inverted trimetric view of the cover of the BSA.
Figure 6:
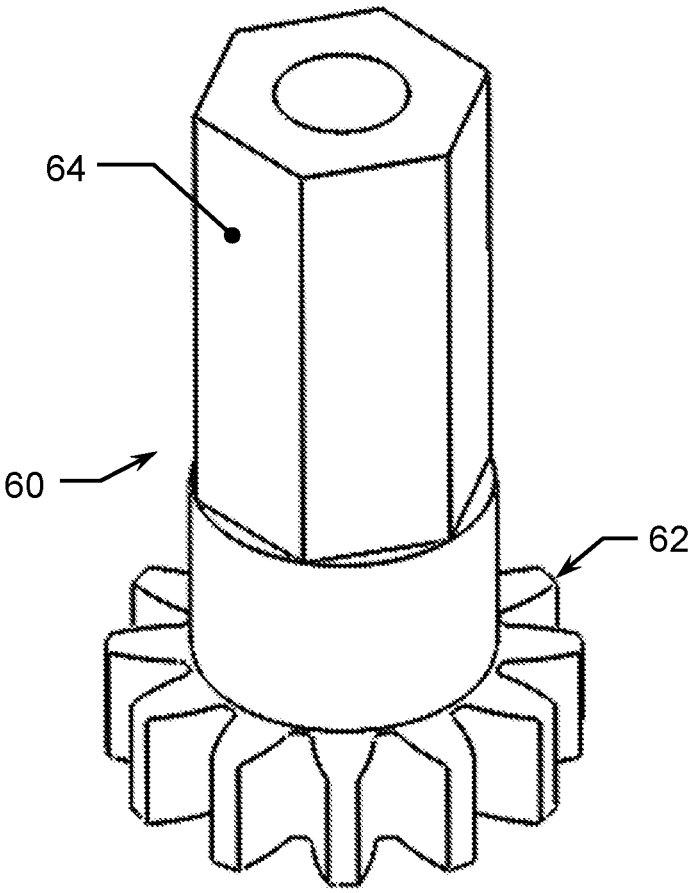
FIG. 6 is a trimetric view of the drive gear of the BSA.
Figure 7:
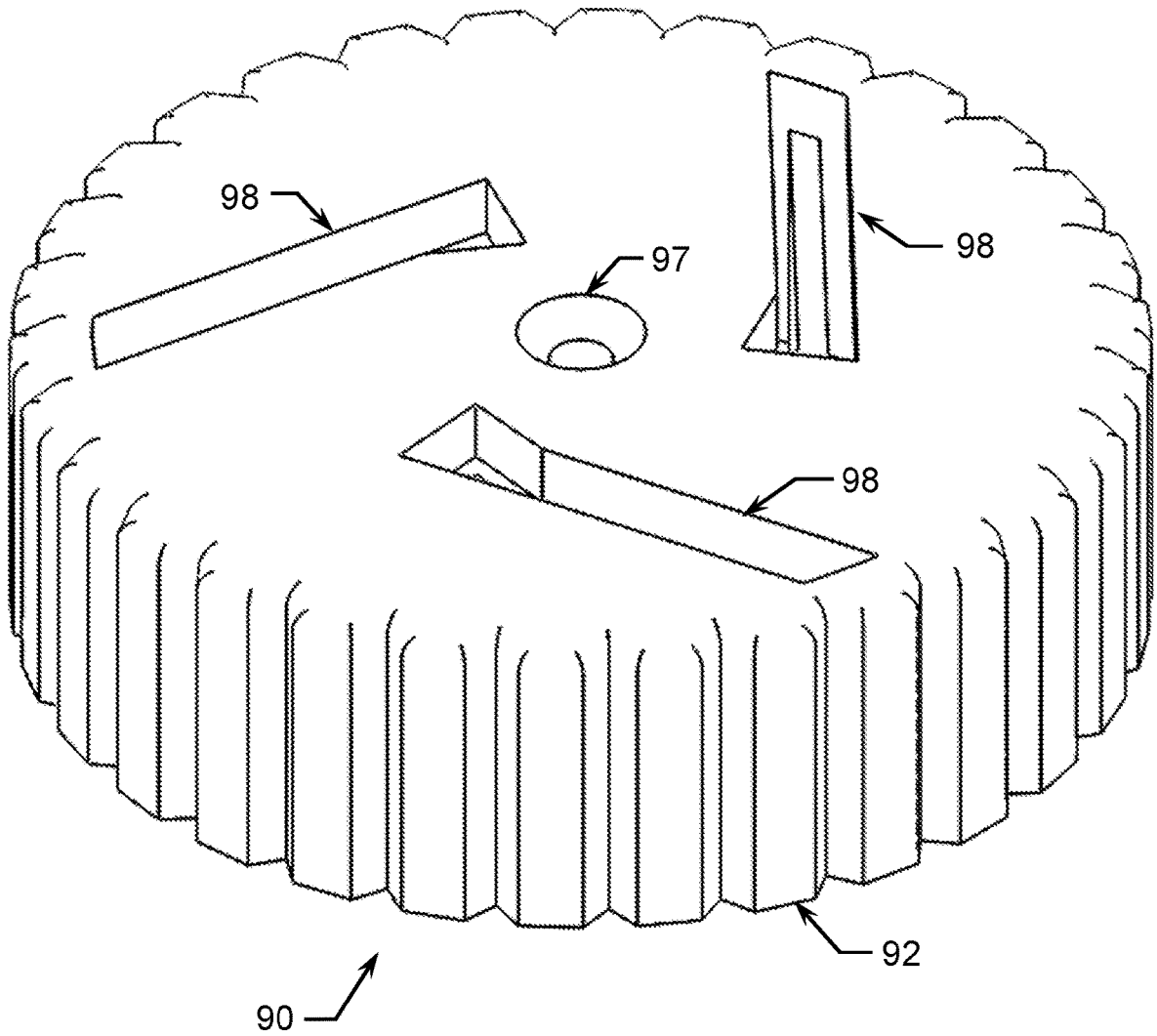
FIG. 7 is a trimetric view of the adjustment knob of the BSA.
Figure 8:
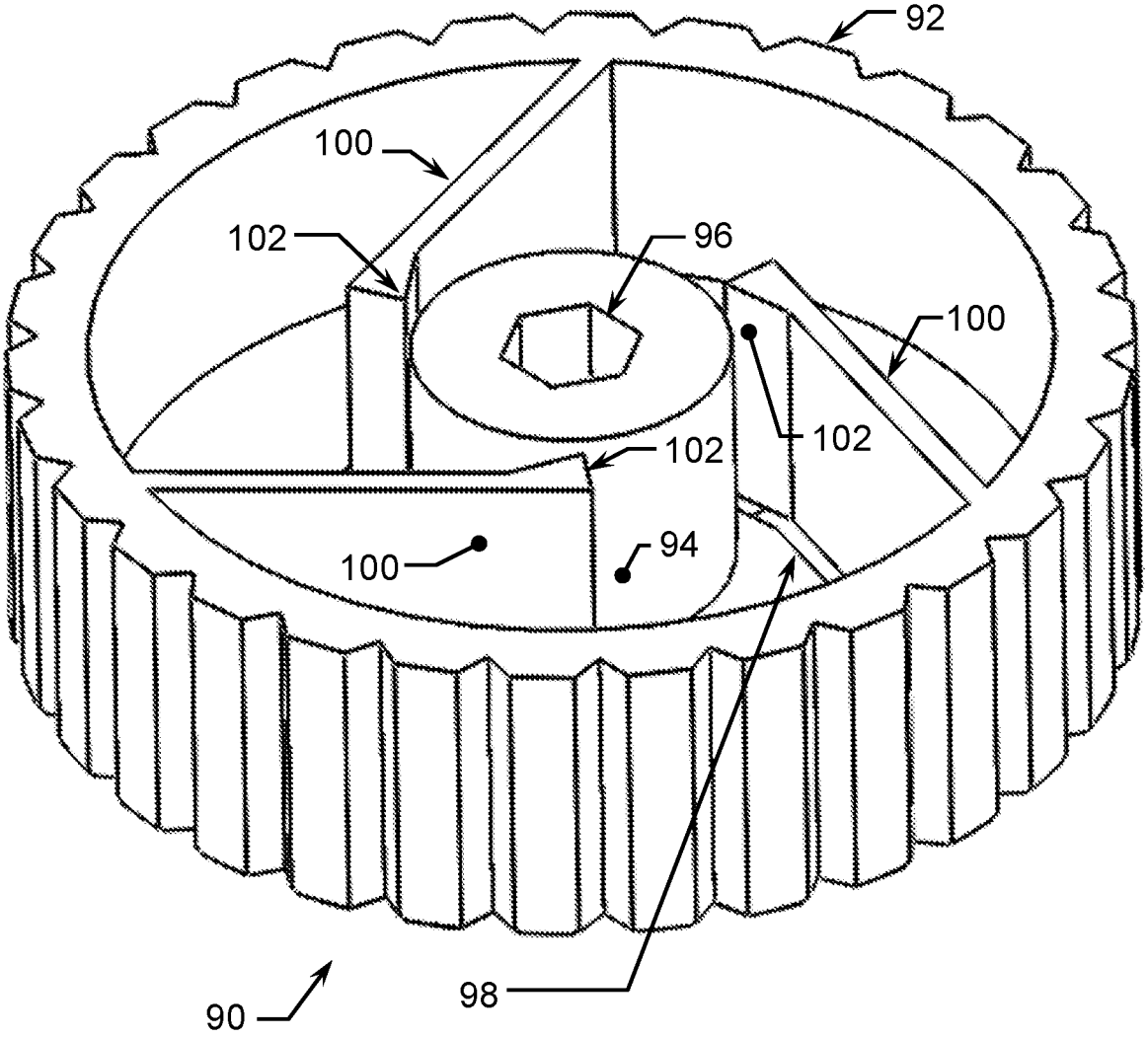
FIG. 8 is an inverted trimetric view of the adjustment knob of the BS.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are included to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

In order to facilitate the understanding of the present invention in reviewing the drawings accompanying the specification, a feature table is provided below. It is noted that like features are like numbered throughout all of the figures.

FEATURE TABLE

| # | Feature |
|---|---|
| 10 | Bidirectional spool apparatus |
| 20 | Housing |
| 22 | Housing floor |
| 24 | Housing wall |
| 26 | First cable access hole |
| 27 | Second cable access hole |
| 28 | Raised land |
| 30 | First spool spindle |
| 32 | Second spool spindle |
| 34 | Gear spindle |
| 36 | Fastening post |
| 40 | First geared spool |
| 42 | Spindle hole |
| 44 | Gear teeth |
| 50 | Second geared spool |
| 52 | Spindle hole |
| 54 | Gear teeth |
| 60 | Drive gear |
| 62 | Gear teeth |
| 64 | Hex drive |
| 70 | Cover |
| 72 | Cover deck |
| 74 | First spool hole |
| 76 | Second spool hole |
| 78 | Drive gear hole |
| 80 | Collar |
| 82 | Collar teeth |
| 84 | Fastening hole |

-continued

FEATURE TABLE

| # | Feature |
|---|---|
| 90 | Adjustment knob |
| 92 | Knob knurl |
| 94 | Collar |
| 96 | Hex drive |
| 98 | Cam opening |
| 100 | Cam |
| 102 | Cam tooth |
| 110 | Knob fastener |
| 112 | Housing fastener |
| 114 | First cable |
| 115 | Second cable |

Referring now to the drawings, a first embodiment of bidirectional spool apparatus (BSA) 10 comprises housing 20, first geared spool 40, second geared spool 50, drive gear 60, cover 70, adjustment knob 90, knob fastener 110, a plurality of housing fasteners 112, and cable 114. Housing 20 preferably defines a plastic injection molded housing having floor 22, wall 24, a first cable access hole 26, a second cable access hole 27, raised land 28, first spool spindle 30, second spool spindle 32, gear spindle 34, and a plurality of fastening posts 36. First geared spool 40 preferably defines a plastic injection molded spool having spindle hole 42, and a plurality of gear teeth 44. Second geared spool 50 preferably defines a plastic injection molded spool having spindle hole 52, and a plurality of gear teeth 54. Drive gear 60 preferably defines a plastic injection drive gear having a plurality of gear teeth 62, and hexagonal shaped hex drive 64. Cover 70 preferably defines a plastic injection molded cover having deck 72, first spool hole 74, second spool hole 76, drive gear hole 78, collar 80, a plurality of collar teeth 82, and a plurality of fastening holes 84. Adjustment knob 90 preferably defines a plastic injection molded adjustment knob having a plurality of knurls 92, collar 94, hexagonal shaped hex drive 96, a fastening hole 97, a plurality of cam openings 98, and a plurality of cams 100, each cam 100 defining a flexible cantilevered flange cam, with each cam 100 having a cam tooth 102. Knob fastener 110, housing fasteners 112 preferably define conventional threaded fasteners. Cable 114 and cable 115 define conventional, preferably closed loop, cables such as cables that can secure a breath deflector (e.g. the breath deflector of US 20200179172), a shoe, or a boot.

BSA 10 is assembled such that first geared spool 40 is rotatably positioned on first spool spindle 30, second geared spool 50 is rotatably positioned on second spool spindle 32, and drive gear 60 is rotatably positioned on gear spindle 34. Cable 114 is wound around first geared spool 40, passed through cable access hole 26, and connected to an objected to be adjustably secured (e.g. the breath deflector of US 20200179172). Cable 115 is wound around second geared spool 50, passed through cable access hole 27, and connected to an objected to be adjustably secured (e.g. the breath deflector of US 20200179172). Cover 70 is then placed on housing 20 such that first spool spindle 30 is positioned within first spool hole 74, second spool spindle 32 is positioned within second spool hole 76, and drive gear 60 is positioned within drive gear hole 78. Adjustment knob 90 is then rotatably positioned on cover 70 such that collar 94 is slidably positioned within collar 80, hex drive 64 is engaged with hex drive 96, and cam teeth 102 are meshed with collar teeth 82. Fastener 110 is threaded through fastening hole 97 and into drive gear 60 such that drive gear 60 is secured to adjustment knob 90 such that rotation of adjustment knob 90 causes a corresponding rotation of drive gear 60. Fasteners 112 are passed through fastening holes 84 and securingly threaded into fastening posts 36.

In practice, in order to tighten the object (e.g. the breath deflector of US 20200179172), a user pushes adjustment knob 90 inward along the rotational axis of adjustment knob 90 causing teeth 62 of drive gear 60 to mesh with gear teeth 44 of first geared spool 40 and causing BSA 10 to enter a tightening mode. In the tightening mode, first geared spool 40 is in a drivable configuration and second geared spool 50 is in a freely rotatable (but for the friction of the apparatus) configuration. A user then rotates adjustment knob 90. The rotation of adjustment knob 90 causes first geared spool 40 to wind and tighten (reduce the payout of) cable 114 while allowing second geared spool 50 to rotate substantially freely and to allow cable 115 to loosen (increase the payout of), causing the object to be moved in a tightening direction. In order to loosen the object (e.g. the breath deflector of US 20200179172), a user pulls adjustment knob 90 outward along the rotational axis of adjustment knob 90 causing teeth 62 of drive gear 60 to mesh with gear teeth 54 of second geared spool 50 and causing BSA 10 to enter a loosening mode. In the loosening mode, first geared spool 40 is in a freely rotatable (but for the friction of the apparatus) configuration and second geared spool 50 is in a drivable configuration. A user then rotates adjustment knob 90. This rotation of adjustment knob 90 causes second geared spool 50 to wind and tighten (reduce the payout of) cable 115 while allowing first geared spool 40 to rotate substantially freely and to allow cable 114 to loosen (increase the payout of), causing the object to be moved in a loosening direction. It is noted that when adjustment knob 90 is rotated, cam teeth 102 of cams 100 sequentially flexingly engage and disengage collar teeth 82 providing for tactile feedback to a user who rotates adjustment knob 90 and causing adjustment knob 90 to remain in a fixed rotational adjustment position in the absence of a user applied rotational load on adjustment knob 90.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A reel based apparatus for tightening and loosening an article comprising a housing, a plurality of spools, a plurality of tension members, and an adjustment knob, wherein said plurality of spools are rotatably secured within said housing and each of said plurality of tension members are wound around a respective spool and extend outside of said housing, and wherein said apparatus is adapted such that when said adjustment knob is in a first configuration and rotated, a first tension member is wound in a tightening direction and a second tension member is allowed to payout, and wherein when said adjustment knob is in a second configuration and rotated, said second tension member is wound a tightening direction and said first tension member is allowed to payout.

2. The apparatus of claim 1, wherein when said adjustment knob is in a first configuration and rotated said article is moved to a tightened position and wherein when said adjustment knob is in a second configuration and rotated said article is moved to a loosened position.

3. The apparatus of claim 1, wherein when said adjustment knob is in a second configuration and rotated, a positive loosening load is placed on said article.

4. The apparatus of claim 1, wherein rotation of said adjustment knob provides a tactile user feedback commensurate to a degree of rotation of said adjustment knob.

5. The apparatus of claim 1, wherein in the absence of a user applied rotational load on said adjustment knob, said at least one spool remains rotationally fixed.

6. The apparatus of claim 1, wherein when said adjustment knob is rotated, at least one of tightening and loosening is affected in at least one of a breath deflector, a garment, and a footwear.

7. The apparatus of claim 1, wherein said adjustment knob includes a plurality of flexible cantilevered cam arms.

8. The apparatus of claim 7, wherein said plurality of flexible cantilevered cam arms are snappingly engaged into teeth extending from said housing.

9. A reel based apparatus for tightening and loosening an article comprising a housing, a plurality of spools, a plurality of tension members, and an adjustment knob, wherein said plurality of spools are rotatably secured within said housing and each of said plurality of tension members are wound around a respective spool and extend outside of said housing, and wherein said apparatus is adapted such that when said adjustment knob is in a first configuration and rotated, a first tension member is wound in a tightening direction and a second tension member is allowed to payout, and wherein when said adjustment knob is in a second configuration and rotated, said second tension member is wound a tightening direction and said first tension member is allowed to payout, and wherein rotation of said adjustment knob provides a tactile user feedback commensurate to a degree of rotation of said adjustment knob, and wherein in the absence of a user applied rotational load on said adjustment knob, said at least one spool remains rotationally fixed.

10. The apparatus of claim 9, wherein when said adjustment knob is in a first configuration and rotated said article is moved to a tightened position and wherein when said adjustment knob is in a second configuration and rotated said article is moved to a loosened position, and wherein when said adjustment knob is in a second configuration and rotated, a positive loosening load is placed on said at least one tension member.

11. The apparatus of claim 9, wherein when said adjustment knob is rotated, at least one of tightening and loosening is affected in at least one of a breath deflector, a garment, and a footwear.

12. The apparatus of claim 9, wherein said adjustment knob includes a plurality of flexible cantilevered cam arms snappingly engaged into teeth extending from said housing.

13. A method of adjusting an article comprising providing a reel based apparatus comprising a housing, a plurality of spools, a plurality of tension members, and an adjustment knob, wherein said plurality of spools are rotatably secured within said housing and each of said plurality of tension members are wound around a respective spool and extend outside of said housing, and wherein said apparatus is adapted such that when said adjustment knob is in a first configuration and rotated, a first tension member is wound in a tightening direction and a second tension member is allowed to payout, and wherein when said adjustment knob is in a second configuration and rotated, said second tension member is wound a tightening direction and said first tension member is allowed to payout, and rotating said adjustment knob so as to affect at least one of tightening a first tension member while allowing a second tension member to loosen and tightening a second tension member while allowing a first tension member to loosen.

14. The method of claim 13, wherein said method further includes at least one of causing said adjustment knob to be extended and causing said adjustment knob to be retracted.

15. The method of claim 13, wherein when said adjustment knob is in a first configuration and rotated said article is moved to a tightened position and wherein when said adjustment knob is in a second configuration and rotated said article is moved to a loosened position.

16. The method of claim 13, wherein when said adjustment knob is in a second configuration and rotated, a positive loosening load is placed on said article.

17. The method of claim 13, wherein rotation of said adjustment knob provides a tactile user feedback commensurate to a degree of rotation of said adjustment knob.

18. The method of claim 13, wherein in the absence of a user applied rotational load on said adjustment knob, said at least one spool remains rotationally fixed.

19. The method of claim 13, wherein when said adjustment knob is rotated, at least one of tightening and loosening is affected in at least one of a breath deflector, a garment, and a footwear.

20. The method of claim 13, wherein said adjustment knob includes a plurality of flexible cantilevered cam arms snappingly engaged into teeth extending from said housing.

* * * * *